US009947271B2

(12) United States Patent
Wang et al.

(10) Patent No.: US 9,947,271 B2
(45) Date of Patent: Apr. 17, 2018

(54) THRESHOLD VOLTAGE DETECTION CIRCUIT FOR OLED DISPLAY DEVICE

(71) Applicant: Shenzhen China Star Optoelectronics Technology Co., Ltd., Shenzhen (CN)

(72) Inventors: Zhenling Wang, Shenzhen (CN); Taijiun Hwang, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 19 days.

(21) Appl. No.: 15/116,224

(22) PCT Filed: Jun. 20, 2016

(86) PCT No.: PCT/CN2016/086429

§ 371 (c)(1),
(2) Date: Aug. 3, 2016

(87) PCT Pub. No.: WO2017/197702

PCT Pub. Date: Nov. 23, 2017

(65) Prior Publication Data

US 2017/0372655 A1 Dec. 28, 2017

(30) Foreign Application Priority Data

May 18, 2016 (CN) ..... 2016 1 0332718

(51) Int. Cl.

| | |
|---|---|
| ***G09G 3/36*** | (2006.01) |
| ***G09G 3/325*** | (2016.01) |
| ***G09G 3/3258*** | (2016.01) |

(52) U.S. Cl.
CPC ..... *G09G 3/325* (2013.01); *G09G 3/3258* (2013.01); *G09G 2320/08* (2013.01)

(58) Field of Classification Search
CPC ..... G09G 3/325; G09G 3/3258
(Continued)

(56) References Cited

U.S. PATENT DOCUMENTS 7,852,331 B2 * 12/2010 Garverick ..... G09G 3/34 345/211
2007/0109285 A1 * 5/2007 Garverick ..... G09G 3/34 345/204

(Continued)

FOREIGN PATENT DOCUMENTS

CN 104132920 A 6/2015

*Primary Examiner* — Prabodh M Dharia
(74) *Attorney, Agent, or Firm* — Leong C. Lei

(57) ABSTRACT

A threshold voltage detection circuit for OLED display device includes a multiplexer connected between a detection IC and each of multiple sub-pixel driver circuits of a pixel driver unit. A second DC signal having first and second levels with the first level smaller than the detection control signal and the second level larger than the detection control signal is fed to each of the sub-pixel driver circuits, such that during detection of threshold of a driver TFT, the second DC signal is switched to the second level and during detection of threshold of an OLED, the second DC signal is switched to the first level and a data signal is set at the same level as the detection control signal to achieve detection of the threshold voltages of the OLED and driver TFT of each sub-pixel driver circuit.

15 Claims, 6 Drawing Sheets

(58) Field of Classification Search
USPC ..... 345/77, 204–214, 92; 1/1; 315/119, 121, 315/122, 224, 169.3
See application file for complete search history.

(56) References Cited

U.S. PATENT DOCUMENTS

| | | | | |
|---|---|---|---|---|
| 2010/0295860 | A1* | 11/2010 | Somerville | G09G 3/3216 345/545 |
| 2010/0295861 | A1* | 11/2010 | Somerville | G09G 3/3216 345/545 |
| 2016/0104427 | A1* | 4/2016 | Matsueda | G09G 3/3233 345/212 |
| 2016/0291736 | A1* | 10/2016 | Tamaki | G06F 3/044 |
| 2017/0023966 | A1* | 1/2017 | Kim | G05F 3/245 |
| 2017/0192534 | A1* | 7/2017 | Han | G06F 3/0383 |
| 2017/0193906 | A1* | 7/2017 | Li | G09G 3/3258 |
| 2017/0223796 | A1* | 8/2017 | Duan | H05B 33/0845 |
| 2017/0242541 | A1* | 8/2017 | Iuchi | G06F 3/0412 |
| 2017/0285869 | A1* | 10/2017 | Roziere | G06F 3/0418 |
| 2017/0300252 | A1* | 10/2017 | Yim | G06F 3/0619 |

* cited by examiner

THRESHOLD VOLTAGE DETECTION CIRCUIT FOR OLED DISPLAY DEVICE

BACKGROUND OF THE INVENTION

1. Field of the Invention

The present invention relates to the field of display, and in particular to a threshold voltage detection circuit for organic light-emitting diode (OLED) display device.

2. The Related Arts

The organic light emitting diode (OLED) provides the advantages of self-luminous, low driving voltage, high luminous efficiency, short response time, high clarity and contrast, wide viewing angle of near-180°, wide operating temperature range, enabling flexible display and large full-color display, and is recognized as the most promising technology.

The driving types of OLED can be divided according to the passive matrix OLED (PMOLED) and active matrix OLED (AMOLED); i.e., the directly addressable and thin film transistor (TFT) array addressable; wherein the AMOLED has pixels arranged in an array layout, belonging to the active matrix, and high luminance efficiency; thus, is often used for high-resolution large-size display devices.

The AMOLED is a current-driven element. When the current flows through the OLED, the OLED emits light, and the luminance intensity is determined by the current flowing through the OLED. The known integrated circuit (IC) mostly transmits only voltage signals, and thus the pixel driver circuit for AMOLED must perform converting the voltage signal to a current signal.

As shown in FIG. 1, FIG. 1 is a schematic view of a known pixel driver circuit for AMOLED, which comprises: a first thin film transistor (TFT) T10, a second TFT T20, a third TFT T30, a storage capacitor C10 and an OLED D10. The first TFT T10 is a switch TFT, and the second TFT T20 is a driver TFT. The first TFT T 10 has the gate connected to receive a scan signal Scan, the source connected to receive a data signal Data, the drain connected to a first node P. The second TFT T20 has the gate connected to the first node P, the source connected directly to a direct current (DC) high vdd, and the drain connected to a second node Q. The third TFT T30 has the gate connected to receive a sensing signal Sensing, the source connected to receive a detection control signal Monitor, and the drain connected to the second node Q. The storage capacitor C10 has one end connected to the first node P and the other end connected to the second node Q. The OLED D10 has the anode connected to the second node Q, and the cathode connected directly to the DC low vss. Because the OLED D10 will degrade as the time passes, the threshold voltage will change. Therefore, even with the same driver current is supplied to the OLED D10, the luminance of OLED D10 will gradually change as the time passes. It is necessary to perform detection on the threshold voltage of the OLED D10 and the driver TFT in order to compensate the data signal Data based on the detected threshold voltage to maintain the constant luminance of the OLED D10. In the pixel driver circuit of the AMOLED shown in FIG. 1, the detection control signal Monitor is inputted to the second node Q to perform threshold voltage detection on the OLED D10 or the driver TFT. At this point, the OLED D10 or the driver TFT is prone to current leakage, which affects the threshold voltage detection on the OLED D10 or the driver TFT.

In addition, as shown in FIG. 2, the plurality of sub-pixel driver circuits 310 of each pixel driver unit 30 of the known threshold voltage detection circuit for OLED display device is directly connected to the output end of the detection IC 10, and is unable to achieve a sub-pixel by sub-pixel detection and compensation for the plurality of sub-pixel driver circuits 310.

SUMMARY OF THE INVENTION

The object of the present invention is to provide a threshold voltage detection circuit for OLED display device, able to detect the threshold voltage of the OLED and driver TFT of each sub-pixel driver circuit in a sub-pixel by sub-pixel manner, to reduce the current leakage of the OLED and driver TFT during the threshold voltage detection and improve the accuracy of the threshold voltage detection and prolong the lifespan of the OLED.

To achieve the above object, the present invention provides a threshold voltage detection circuit for OLED display device, which comprises: a detection IC, a plurality of multiplexers, and a plurality of pixel driver units; the detection IC comprising: a plurality of output ends for outputting detection control signals, with each output end connected to a multiplexer and each multiplexer connected to a pixel driver unit; each pixel driver unit comprising a plurality of sub-pixel driver circuits, each multiplexer comprising a plurality of control units corresponding respectively to the plurality of sub-pixel driver circuits; the input ends of the plurality of control units of the same multiplexer being all connected to the same output end of the detection IC, the control ends connected respectively to a branch control signal, and the output ends connected respectively to a sub-pixel driver circuit; each sub-pixel driver circuit comprising: a first TFT, a second TFT, a third TFT, a storage capacitor, and an OLED; the first TFT having the gate connected to receive a scan signal, the source connected to receive a data signal, and the drain connected to a first node; the second TFT having the gate connected to the first node, the source connected to a first direct current (DC) signal, and the drain connected to a second node; the third TFT having the gate connected to receive a sensing signal, the source connected to receive a detection control signal outputted by the output end of the control unit corresponding to the sub-pixel driver circuit, and the drain connected to the second node; the storage capacitor having one end connected to the first node and the other end connected to the second node; the OLED having the anode connected to the second node, and the cathode connected to a second DC signal; the second DC signal having a first level and a second level, the first level being less than the level of the detection control signal, and the second level being greater than the level of the detection control signal.

Each pixel driver unit comprises three sub-pixel driver circuits, which are a red sub-pixel driver circuit, a green sub-pixel driver circuit, and a blue sub-pixel driver circuit.

Each pixel driver unit comprises four sub-pixel driver circuits, which are a red sub-pixel driver circuit, a green sub-pixel driver circuit, a blue sub-pixel driver circuit, and a white sub-pixel driver circuit.

The control unit is a TFT, the TFT has the gate as the control end of the control unit, the source as the input end of the control unit and the drain as the output end of the control unit.

During the threshold voltage detection circuit for the OLED display device detecting the threshold voltage of the second TFT, the second DC signal is at the second level.

During the threshold voltage detection circuit for the OLED display device detecting the threshold voltage of the OLED, the second DC signal is at the first level, and the data signal is at the same level as the detection control signal.

The plurality of control units of the multiplexer becomes conductive one by one, and outputs a detection control signal to each sub-pixel driver circuit one by one.

The detection IC comprises an analog-to-digital converter (ADC).

The threshold voltage detection circuit for OLED display device further comprises a memory connected to the detection IC.

The present invention also provides a threshold voltage detection circuit for OLED display device, which comprises: a detection IC, a plurality of multiplexers, and a plurality of pixel driver units; the detection IC comprising: a plurality of output ends for outputting detection control signals, with each output end connected to a multiplexer and each multiplexer connected to a pixel driver unit; each pixel driver unit comprising a plurality of sub-pixel driver circuits, each multiplexer comprising a plurality of control units corresponding respectively to the plurality of sub-pixel driver circuits; the input ends of the plurality of control units of the same multiplexer being all connected to the same output end of the detection IC, the control ends connected respectively to a branch control signal, and the output ends connected respectively to a sub-pixel driver circuit; each sub-pixel driver circuit comprising: a first TFT, a second TFT, a third TFT, a storage capacitor, and an OLED; the first TFT having the gate connected to receive a scan signal, the source connected to receive a data signal, and the drain connected to a first node; the second TFT having the gate connected to the first node, the source connected to a first direct current (DC) signal, and the drain connected to a second node; the third TFT having the gate connected to receive a sensing signal, the source connected to receive a detection control signal outputted by the output end of the control unit corresponding to the sub-pixel driver circuit, and the drain connected to the second node; the storage capacitor having one end connected to the first node and the other end connected to the second node; the OLED having the anode connected to the second node, and the cathode connected to a second DC signal; the second DC signal having a first level and a second level, the first level being less than the level of the detection control signal, and the second level being greater than the level of the detection control signal; wherein each pixel driver unit comprising four sub-pixel driver circuits, which being a red sub-pixel driver circuit, a green sub-pixel driver circuit, a blue sub-pixel driver circuit, and a white sub-pixel driver circuit; wherein the control unit being a TFT, the TFT having the gate as the control end of the control unit, the source as the input end of the control unit and the drain as the output end of the control unit.

Compared to the known techniques, the present invention provides the following advantages: the present invention provides a threshold voltage detection circuit for OLED display device, providing multiplexers between the detection IC and the pixel driver unit so as to achieve sub-pixel by sub-pixel threshold voltage detection for the OLED and driver TFT of each sub-pixel driver circuit in the pixel driver unit, and reduce the number of output ends of the detection IC. Also, by using the second DC signal having the first and second levels with the first level smaller than the detection control signal and the second level larger than the detection control signal, during the detection for driver TFT, the second DC signal is switched to the second level to make the OLED reverse biased to reduce the impact of the OLED current leakage on the threshold voltage of the driver TFT, eliminate the built-in electric field of OLED and prolong the OLED lifespan; during the detection for OLED, the second DC signal is switched to the first level to make the OLED conductive and the data signal is at the same level as the detection control signal to guarantee the driver TFT is cut off to reduce the impact of the driver TFT current leakage on the threshold voltage of the OLED, and improve detection accuracy.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technical means and effect of the present invention, the following refers to embodiments and drawings for detailed description.

Figure 1:
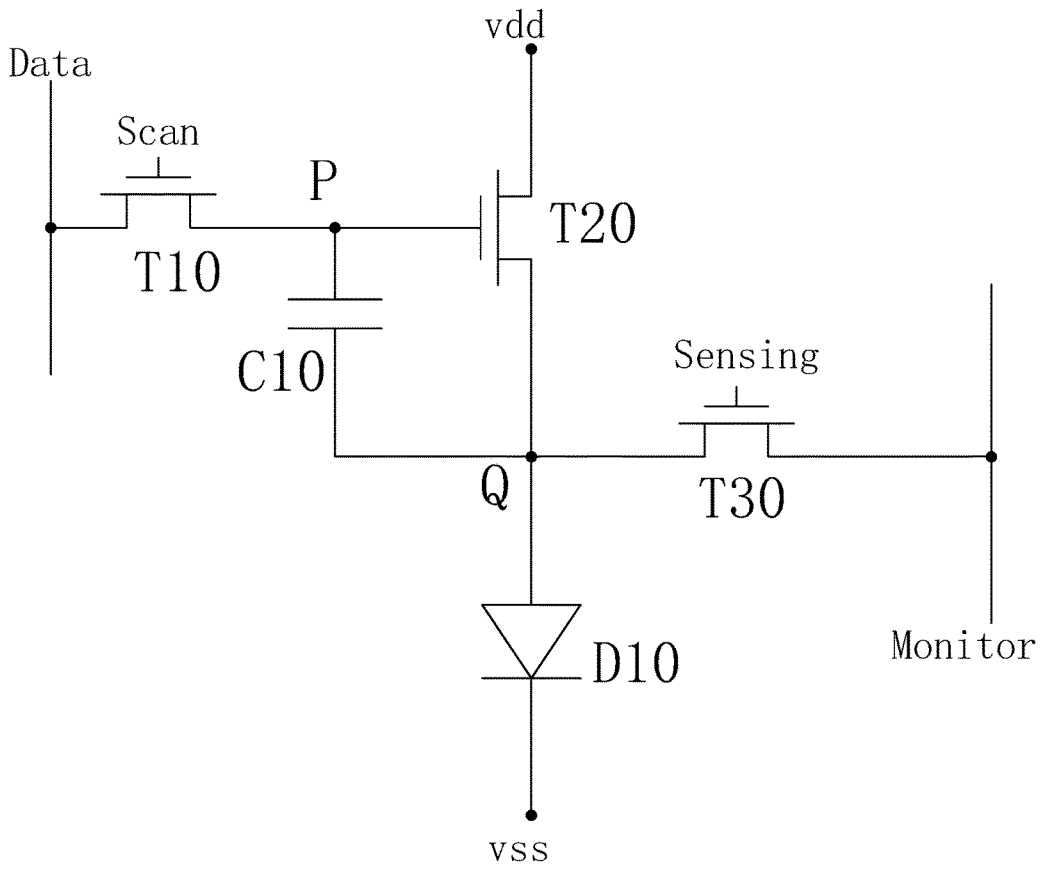
FIG. 1 is a schematic view showing a known pixel driver circuit for AMOLED.
Figure 2:
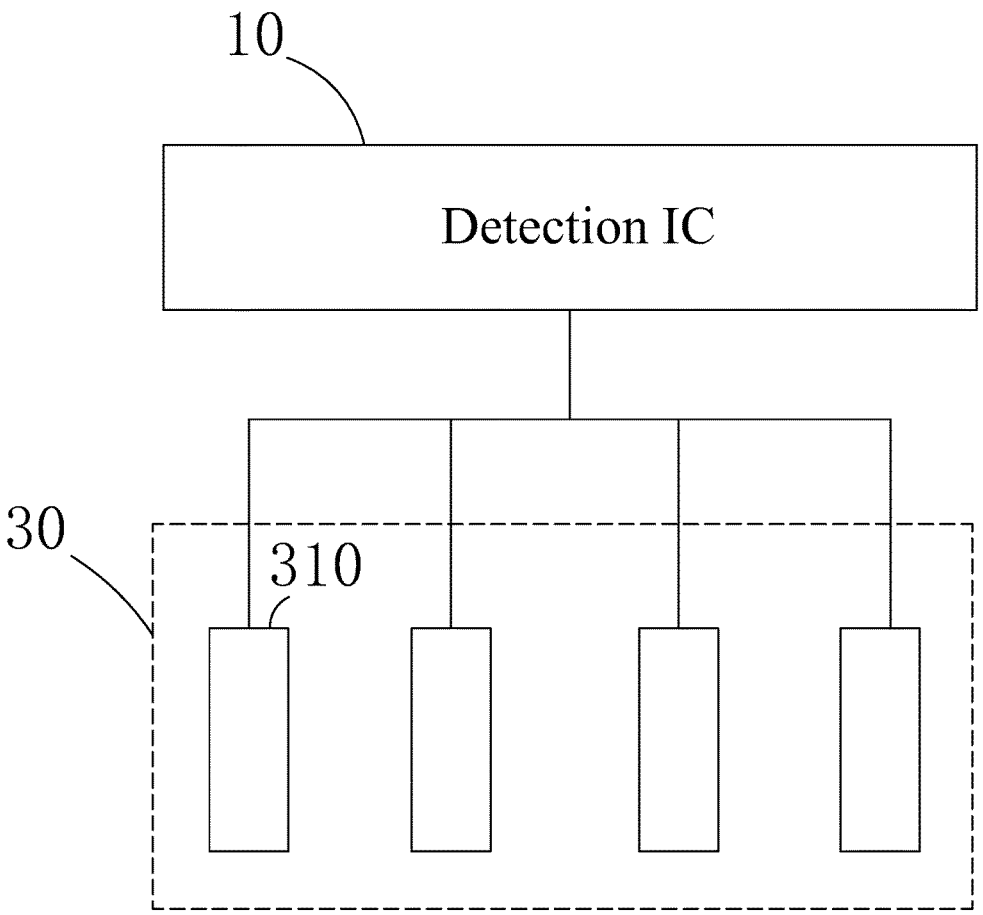
FIG. 2 is a schematic view showing a known threshold voltage detection circuit for OLED display device.
Figure 3:
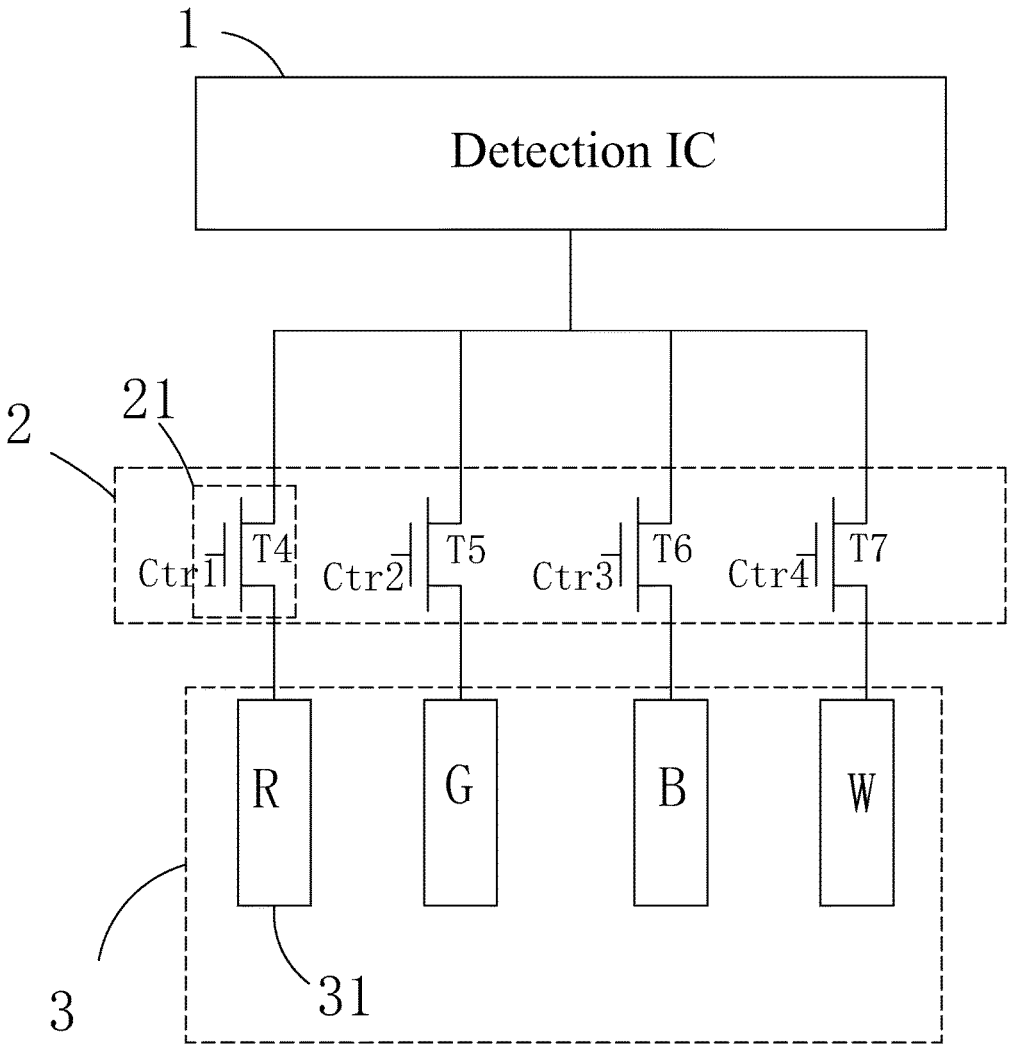
FIG. 3 is a schematic view showing the threshold voltage detection circuit for OLED display device provided by an embodiment of the present invention.

Refer to FIG. 3. The present invention provides a threshold voltage detection for OLED display device, which comprises: a detection IC 1, a plurality of multiplexers 2, and a plurality of pixel driver units 3.

Specifically, the detection IC 1 comprises: a plurality of output ends for outputting detection control signals Monitor, with each output end connected to a multiplexer 2 and each multiplexer 2 connected to a pixel driver unit 3; each pixel driver unit 3 comprises a plurality of sub-pixel driver circuits 31, each multiplexer 2 comprising a plurality of control units 21 corresponding respectively to the plurality of sub-pixel driver circuits 31.

Specifically, the input ends of the plurality of control units 21 of the same multiplexer 2 are all connected to the same output end of the detection IC 1, the control ends connected respectively to a branch control signal, and the output ends connected respectively to a sub-pixel driver circuit 31.

Optionally, each pixel driver unit 3 comprises four sub-pixel driver circuits 31, which are a red sub-pixel driver circuit R, a green sub-pixel driver circuit G, a blue sub-pixel driver circuit B, and a white sub-pixel driver circuit W. The control unit 21 is a TFT, the TFT has the gate as the control end of the control unit 21, the source as the input end of the control unit 21 and the drain as the output end of the control unit 21. Correspondingly, each multiplexer 2 in the first embodiment comprises four TFTs, which are the fourth TFT T4, the fifth TFT T5, the sixth TFT T6 and the seventh TFT T7, wherein the gates of the fourth TFT T4, the fifth TFT T5, the sixth TFT T6 and the seventh TFT T7 are connected respectively to the first branch control signal Ctr1, the second branch control signal Ctr2, the third branch control signal Ctr3 and the fourth branch control signal Ctr4, the sources are connected to receive the same output end of the detection IC 1, and the drains are connected respectively to the red sub-pixel driver circuit R, green sub-pixel driver circuit G, blue sub-pixel driver circuit B, and white sub-pixel driver circuit W.

Optionally, each pixel driver unit 3 comprises three sub-pixel driver circuits, which are a red sub-pixel driver circuit R, a green sub-pixel driver circuit G, and a blue sub-pixel driver circuit B. In other words, the white sub-pixel driver circuit W and the seventh TFT T7 in the first embodiment are eliminated to obtain the second embodiment. That is, the threshold voltage detection circuit for OLED display device of the present invention is applicable to an OLED display device of RGBW display architecture as well as RGB display architecture.

Figure 4:
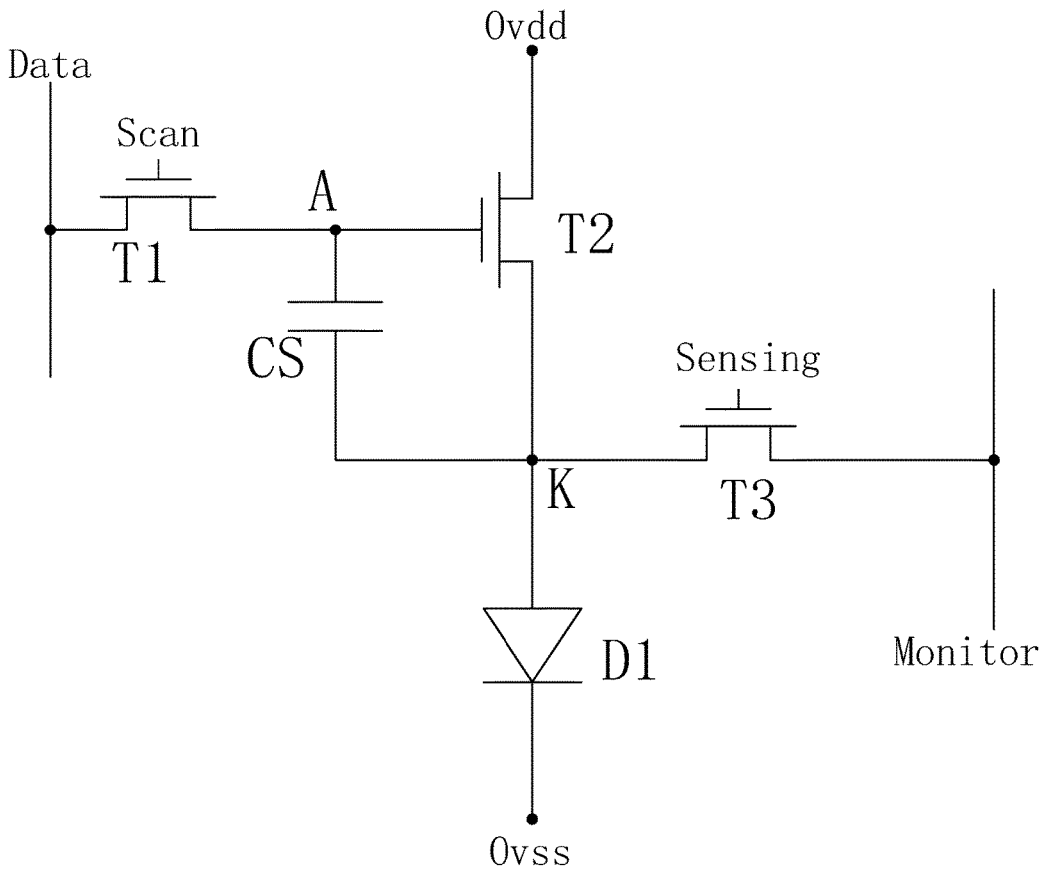
FIG. 4 is a schematic view showing the pixel driver circuit of the threshold voltage detection circuit for OLED display device provided by an embodiment of the present invention.

Specifically, refer to FIG. 4. Each sub-pixel driver circuit 31 comprises: a first TFT T1, a second TFT T2, a third TFT T3, a storage capacitor CS, and an OLED D1.

Wherein the first TFT T1 has the gate connected to receive a scan signal Scan, the source connected to receive a data signal Data, and the drain connected to a first node A; the second TFT T2 has the gate connected to the first node A, the source connected to a first direct current (DC) signal Ovdd, and the drain connected to a second node K; the third TFT T3 has the gate connected to receive a sensing signal Sensing, the source connected to receive a detection control signal Monitor outputted by the output end of the control unit 21 corresponding to the sub-pixel driver circuit 31, and the drain connected to the second node K; the storage capacitor CS has one end connected to the first node A and the other end connected to the second node K; the OLED D1 has the anode connected to the second node K, and the cathode connected to a second DC signal Ovss. The second TFT T2 is the driver TFT.

Specifically, the second DC signal Ovss has a first level and a second level, the first level being less than the level of the detection control signal Monitor, and the second level being greater than the level of the detection control signal Monitor. The detection IC 1 comprises an analog-to-digital converter (ADC), and the threshold voltage detection circuit for OLED display device further comprises a memory connected to the detection IC 1.

It should be noted that the use of the plurality of control units 21 of the multiplexer 2 achieves sub-pixel by sub-pixel threshold voltage detection for the OLED and driver TFT of each sub-pixel driver circuit in the pixel driver unit, and reduce the number of output ends of the detection IC 1 to save the cost.

The threshold voltage detection circuit for the OLED display device is able to detect the threshold voltage of the second TFT T2 or OLED D1, wherein during the threshold voltage detection circuit for the OLED display device detecting the threshold voltage of the second TFT T2, the second DC signal Ovss is at the second level; during the threshold voltage detection circuit for the OLED display device detecting the threshold voltage of the OLED D1, the second DC signal Ovss is at the first level, and the data signal Data is at the same level as the detection control signal Monitor.

Figure 5:
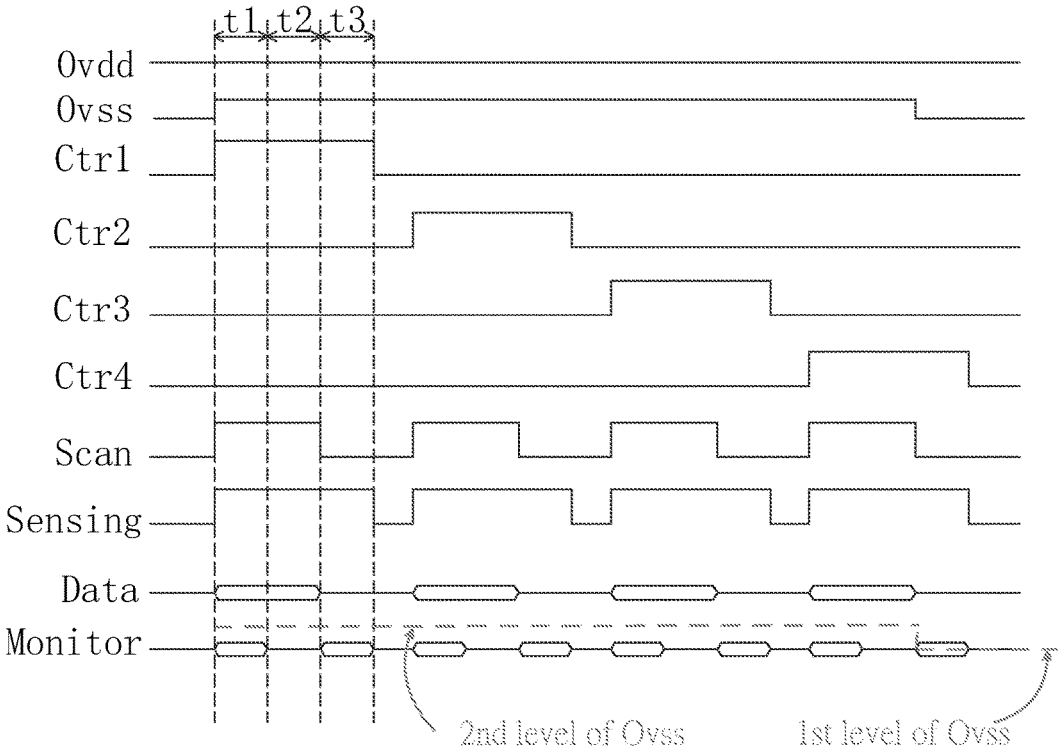
FIG. 5 is a schematic view showing the timing of the threshold voltage detection circuit for OLED display device provided by an embodiment of the present invention detecting the threshold voltage of the driver TFT.

Refer to FIG. 5, and also FIGS. 3-4. The following uses the red sub-pixel driver circuit R in the first embodiment of the present invention as an example to describe the operation of the threshold voltage detection circuit for the OLED display device detecting the threshold voltage of the driver TFT (i.e., the second TFT T2):

First, entering the charging stage t1: the second DC signal Ovss switches to the second level, the first branch control signal Ctr1 is at high level, the fourth TFT T4 is turned on, the detection control signal Monitor is inputted to the red sub-pixel driver circuit R, both the scan signal Scan and the detection signal Sensing provide high level, both the first TFT T1 and the third TFT T3 are both turned on, the detection control signal Monitor and the data signal Data perform charging respectively on the second node K and the first node A.

Then, entering driving stage t2: the second TFT T2 is in a saturated driving mode, the second node K is charged to raise to the difference between the level of the data signal Data and the threshold voltage, and the second DC signal Ovss is at the second level which is greater than the level of the detection control signal Monitor to make the OLED D1 reverse biased to reduce the impact of the OLED D1 current leakage on the threshold voltage detection of the second TFT T2, as well as eliminating the built-in electric field in the OLED d1 and prolonging the OLED d1 lifespan.

Finally, entering the detection stage t3: detect the voltage of the second node K, and transmit to the detection IC 1 to be converted by the ADC of the detection IC 1 to a digital signal for storing in the memory so as to retrieve the corresponding driver TFT threshold voltage from the memory in subsequent operation of the OLED display device.

Furthermore, in the subsequent operation, the second, third and fourth branch control signals Ctr2, Ctr3, Ctr4 provide a high level signal one by one to perform threshold voltage detection on the driver TFT of the green sub-pixel driver circuit G, blue sub-pixel driver circuit B and white sub-pixel driver circuit W. The specific operation is identical to the red sub-pixel driver circuit R and detailed description is not repeated.

Figure 6:
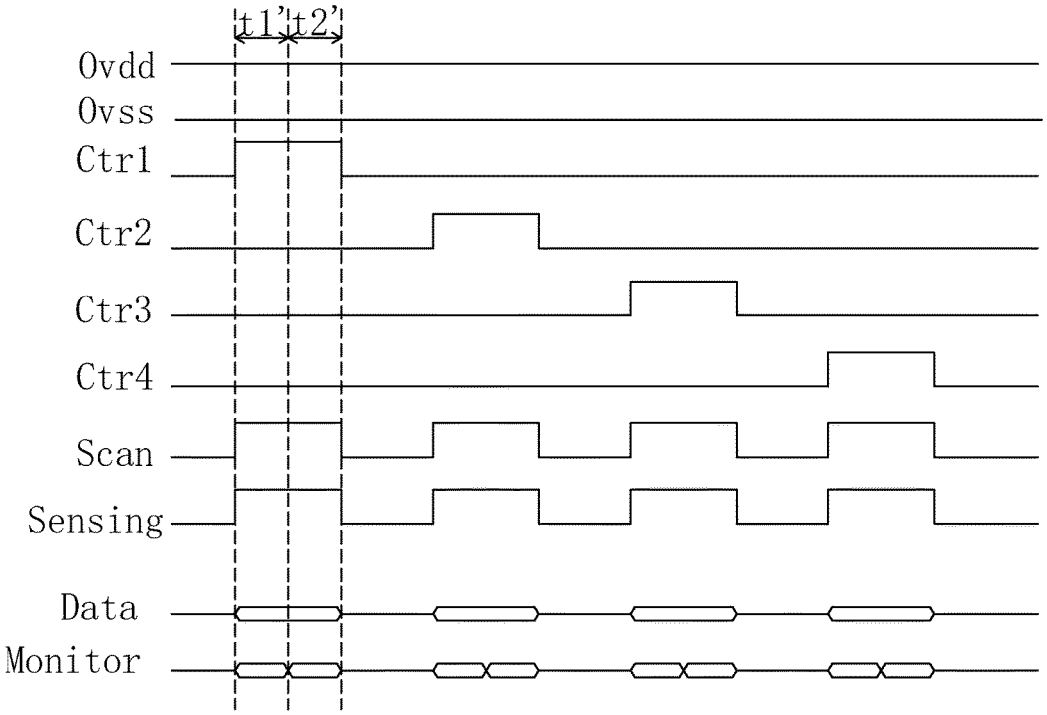
FIG. 6 is a schematic view showing the timing of the threshold voltage detection circuit for OLED display device provided by an embodiment of the present invention detecting the threshold voltage of the OLED.

Refer to FIG. 6, and also FIGS. 3-4. The following uses the red sub-pixel driver circuit R in the first embodiment of the present invention as an example to describe the operation of the threshold voltage detection circuit for the OLED display device detecting the threshold voltage of the OLED D1:

First, entering the charging stage t1': the second DC signal Ovss switches to the first level, the first branch control signal Ctr1 is at high level, the fourth TFT T4 is turned on, the detection control signal Monitor is inputted to the red sub-pixel driver circuit R, both the scan signal Scan and the detection signal Sensing provide high level, both the first TFT T1 and the third TFT T3 are both turned on, the detection control signal Monitor and the data signal Data perform charging respectively on the second node K and the first node A; the detection control signal Monitor and the data signal Data are at the same level to ensure that the second TFT T2 is cut off to avoid current leakage to affect the threshold voltage detection for the OLED D1.

Then, entering the detection stage t3': detect the current flowing through the OLED D1, and transmit to the detection IC 1 to be converted by the ADC of the detection IC 1 to a digital signal, look up a pre-set look-up table of current and voltage (IV LUT) for OLED to obtain the threshold voltage shift of the OLED d1, and use the threshold voltage shift of the OLED d1 to perform luminance compensation on OLED D1 in subsequent operation of the OLED display device.

Furthermore, in the subsequent operation, the second, third and fourth branch control signals Ctr2, Ctr3, Ctr4 provide a high level signal one by one to perform threshold voltage detection on the OLED of the green sub-pixel driver circuit G, blue sub-pixel driver circuit B and white sub-pixel driver circuit W. The specific operation is identical to the red sub-pixel driver circuit R and detailed description is not repeated.

In summary, the present invention provides a threshold voltage detection circuit for OLED display device, providing multiplexers between the detection IC and the pixel driver unit so as to achieve sub-pixel by sub-pixel threshold voltage detection for the OLED and driver TFT of each sub-pixel driver circuit in the pixel driver unit, and reduce the number of output ends of the detection IC. Also, by using the second DC signal having the first and second levels with the first level smaller than the detection control signal and the second level larger than the detection control signal, during the detection for driver TFT, the second DC signal is switched to the second level to make the OLED reverse biased to reduce the impact of the OLED current leakage on the threshold voltage of the driver TFT, eliminate the built-in electric field of OLED and prolong the OLED lifespan; during the detection for OLED, the second DC signal is switched to the first level to make the OLED conductive and the data signal is at the same level as the detection control signal to guarantee the driver TFT is cut off to reduce the impact of the driver TFT current leakage on the threshold voltage of the OLED, and improve detection accuracy.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A threshold voltage detection circuit for organic light-emitting diode (OLED) display device, which comprises: a detection integrated circuit (IC), a plurality of multiplexers, and a plurality of pixel driver units;

the detection IC comprising: a plurality of output ends for outputting detection control signals, with each output end connected to a multiplexer and each multiplexer connected to a pixel driver unit;

each pixel driver unit comprising a plurality of sub-pixel driver circuits, each multiplexer comprising a plurality of control units corresponding respectively to the plurality of sub-pixel driver circuits;

the input ends of the plurality of control units of the same multiplexer being all connected to the same output end of the detection IC, the control ends connected respectively to a branch control signal, and the output ends connected respectively to a sub-pixel driver circuit;

each sub-pixel driver circuit comprising: a first thin film transistor (TFT), a second TFT, a third TFT, a storage capacitor, and an OLED;

the first TFT having the gate connected to receive a scan signal, the source connected to receive a data signal, and the drain connected to a first node;

the second TFT having the gate connected to the first node, the source connected to a first direct current (DC) signal, and the drain connected to a second node;

the third TFT having the gate connected to receive a sensing signal, the source connected to receive a detection control signal outputted by the output end of the control unit corresponding to the sub-pixel driver circuit, and the drain connected to the second node;

the storage capacitor having one end connected to the first node and the other end connected to the second node;

the OLED having the anode connected to the second node, and the cathode connected to a second DC signal; and the second DC signal having a first level and a second level, the first level being less than the level of the detection control signal, and the second level being greater than the level of the detection control signal.

2. The threshold voltage detection circuit for OLED display device as claimed in claim 1, wherein each pixel driver unit comprises three sub-pixel driver circuits, which are a red sub-pixel driver circuit, a green sub-pixel driver circuit, and a blue sub-pixel driver circuit.

3. The threshold voltage detection circuit for OLED display device as claimed in claim 1, wherein each pixel driver unit comprises four sub-pixel driver circuits, which are a red sub-pixel driver circuit, a green sub-pixel driver circuit, a blue sub-pixel driver circuit, and a white sub-pixel driver circuit.

4. The threshold voltage detection circuit for OLED display device as claimed in claim 1, wherein the control unit is a TFT, the TFT has the gate as the control end of the control unit, the source as the input end of the control unit and the drain as the output end of the control unit.

5. The threshold voltage detection circuit for OLED display device as claimed in claim 1, wherein during the threshold voltage detection circuit for the OLED display device detecting the threshold voltage of the second TFT, the second DC signal is at the second level.

6. The threshold voltage detection circuit for OLED display device as claimed in claim 1, wherein during the threshold voltage detection circuit for the OLED display device detecting the threshold voltage of the OLED, the second DC signal is at the first level, and the data signal is at the same level as the detection control signal.

7. The threshold voltage detection circuit for OLED display device as claimed in claim 1, wherein the plurality of control units of the multiplexer becomes conductive one by one, and outputs a detection control signal to each sub-pixel driver circuit one by one.

8. The threshold voltage detection circuit for OLED display device as claimed in claim 1, wherein the detection IC comprises an analog-to-digital converter (ADC).

9. The threshold voltage detection circuit for OLED display device as claimed in claim 1, wherein the threshold voltage detection circuit for OLED display device further comprises a memory connected to the detection IC.

10. A threshold voltage detection circuit for organic light-emitting diode (OLED) display device, which comprises: a detection integrated circuit (IC), a plurality of multiplexers, and a plurality of pixel driver units;

the detection IC comprising: a plurality of output ends for outputting detection control signals, with each output end connected to a multiplexer and each multiplexer connected to a pixel driver unit;

each pixel driver unit comprising a plurality of sub-pixel driver circuits, each multiplexer comprising a plurality of control units corresponding respectively to the plurality of sub-pixel driver circuits;

the input ends of the plurality of control units of the same multiplexer being all connected to the same output end of the detection IC, the control ends connected respectively to a branch control signal, and the output ends connected respectively to a sub-pixel driver circuit;

each sub-pixel driver circuit comprising: a first thin film transistor (TFT), a second TFT, a third TFT, a storage capacitor, and an OLED;

the first TFT having the gate connected to receive a scan signal, the source connected to receive a data signal, and the drain connected to a first node;

the second TFT having the gate connected to the first node, the source connected to a first direct current (DC) signal, and the drain connected to a second node;

the third TFT having the gate connected to receive a sensing signal, the source connected to receive a detection control signal outputted by the output end of the control unit corresponding to the sub-pixel driver circuit, and the drain connected to the second node;

the storage capacitor having one end connected to the first node and the other end connected to the second node;

the OLED having the anode connected to the second node, and the cathode connected to a second DC signal; and the second DC signal having a first level and a second level, the first level being less than the level of the detection control signal, and the second level being greater than the level of the detection control signal;

wherein each pixel driver unit comprises four sub-pixel driver circuits, which are a red sub-pixel driver circuit, a green sub-pixel driver circuit, a blue sub-pixel driver circuit, and a white sub-pixel driver circuit;

wherein the control unit is a TFT, the TFT has the gate as the control end of the control unit, the source as the input end of the control unit and the drain as the output end of the control unit.

11. The threshold voltage detection circuit for OLED display device as claimed in claim 10, wherein during the threshold voltage detection circuit for the OLED display device detecting the threshold voltage of the second TFT, the second DC signal is at the second level.

12. The threshold voltage detection circuit for OLED display device as claimed in claim 10, wherein during the threshold voltage detection circuit for the OLED display device detecting the threshold voltage of the OLED, the second DC signal is at the first level, and the data signal is at the same level as the detection control signal.

13. The threshold voltage detection circuit for OLED display device as claimed in claim 10, wherein the plurality of control units of the multiplexer becomes conductive one by one, and outputs a detection control signal to each sub-pixel driver circuit one by one.

14. The threshold voltage detection circuit for OLED display device as claimed in claim 10, wherein the detection IC comprises an analog-to-digital converter (ADC).

15. The threshold voltage detection circuit for OLED display device as claimed in claim 10, wherein the threshold voltage detection circuit for OLED display device further comprises a memory connected to the detection IC.

* * * * *